United States Patent [19]

Lowell

[11] Patent Number: 4,697,494

[45] Date of Patent: Oct. 6, 1987

[54] PIANO SOUNDBOARD DOWNBEARING FORCE SIMULATOR

[76] Inventor: Thomas A. Lowell, 2360 Galls Cr. Rd., Gold Hill, Oreg. 97525

[21] Appl. No.: 897,996

[22] Filed: Aug. 19, 1986

[51] Int. Cl.[4] ..... G10G 7/00

[52] U.S. Cl. ..... 84/458; 84/174

[58] Field of Search ..... 84/174, 458, 212

[56] References Cited

U.S. PATENT DOCUMENTS 1,705,153 3/1929 Fuhr ..... 84/458

*Primary Examiner*—Benjamin R. Fuller

[57] ABSTRACT

Pianos in which the desired downbearing force of the strings upon the bridges and soundboard is predetermined and accurately simulated upon the soundboard bridges so that adjustments can be made to the bridge-string plate relationship so that the previously simulated force will be exerted upon the soundboard and bridges when the piano is fully strung and at pitch.

17 Claims, 4 Drawing Figures

PIANO SOUNDBOARD DOWNBEARING FORCE SIMULATOR

This invention relates to pianos and has more to do particularly with an improved method of setting the downbearing force which the strings exert upon the soundboard and bridges. While its utility is not so limited the invention will be described as it applies to a grand piano. Such a piano is characterized by a horizontal string plate, a soundboard located beneath the string plate, a keyboard, and an upwardly operationg action, the hammers of which strike the strings from beneath.

A basic object of the invention is to provide a process which improves the accuracy of the adjustment of downbearing in pianos which will improve the tonal characteristics of the instrument.

It is an object of the invention to provide a method of piano construction where said downbearing force can be accurately controlled as to it's distribution along both the length and the width of the soundbeard bridges It is an object of the invention to provide a process whereby the individual angles of the front and rear string segments relative to the bridge string segment can be accurately controlled.

It is an object of the invention to provide a way in which the bearing force exerted upon the bridge by the pianos strings can be predetermined and then achieved and maintained when the piano is fully strung and at pitch.

It is an object of the invention to provide a process by which the unpredictability of the compression of the soundboard which results from the application of the bearing force of the strings against the bridges can be eliminated.

These and other objects of the invention, which will be set forth hereinafter will be apparent to one skilled in the art upon reading these specifications are accomplished by the process of which certain exemplary embodiments will now be described.

Figure 3:
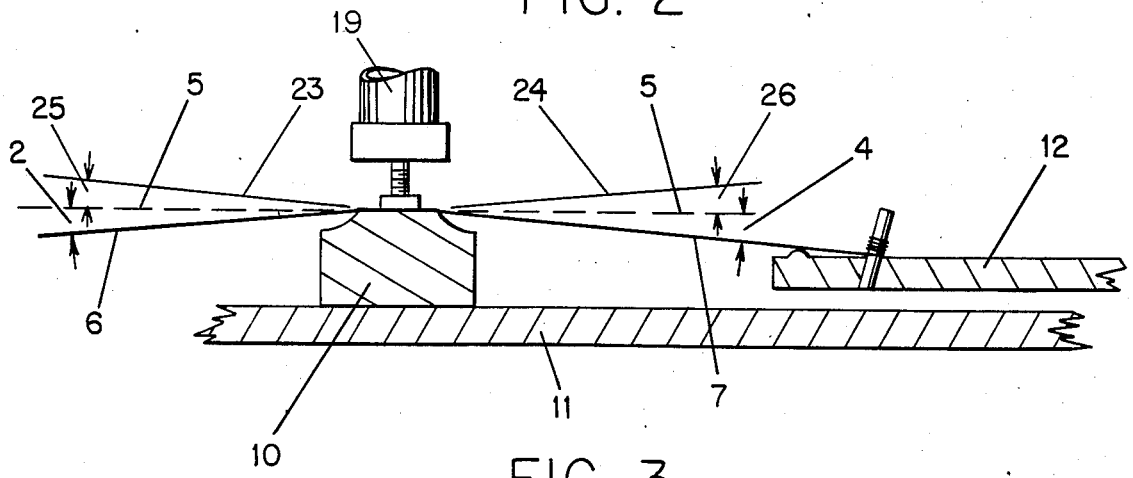
FIG. 3 is a partial sectional view of a grand piano soundboard, bridge, and plate assembly, along with a side view of the soundboard compression air cylinders at work compressing the soundboard. Note also that the bridge has been planed to provide certain angles of the bridge relative to the plate.

The tone quality of the piano is dependent on a number of factors, including those factors which produce a damping action on the strings. There are many such factors and their interaction is extremely complex. The downbearing force of the strings on the bridges is very important. Too much downbearing force, or too little downbearing force, or uneven downbearing force affect the tone. Another factor affecting the quality of the piano tone is the nature of the string angles at the bridge. Strings which have an angle where the string segment proceeds away from the soundboard (see FIG. 3) relative to the bridge string segment (23 FIG. 3) have an adverse effect upon the quality of the string termination, and therefore the quality of the tone. Therefore it becomes important that the downbearing on the piano bridges be adjusted so that (1) the desired amount of force will be exerted upon the bridge and soundboard, and (2) the geometry of the strings is such that the string segments on each side of the bridge (10 FIG. 3) travel towards the soundboard (11 FIG. 3) relative to the string segment atop the bridge, as opposed to traveling away from the soundboard.

Figure 2:
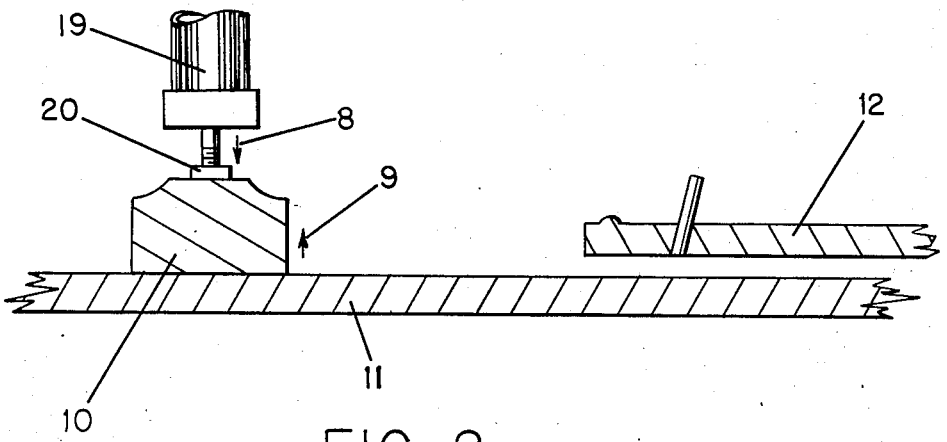
FIG. 2 is a partial sectional view of a grand piano soundboard, bridge, and plate assembly, along with a side view of the soundboard compression air cylinders at work compressing the soundboard.

The piano in FIG. 2 is at the stage of manufacture when the height of of bridge (10 FIG. 2) relative to the string plate (12 FIG. 2) is to be determined and adjusted by planing the top surface of the bridge (10 FIG. 2). The final configuration of the bridge-string plate relationship is difficult to determine because the soundboard (11 FIG. 2) to which the bridge is attached acts like a spring and depresses as force from the deflection by the bridge of the strings is exerted upon the soundboard. Thus as the piano is strung and the strings are tensioned, the soundboard depresses (an unpredictable amount) and whatever previous angles (2, 4, 25, 26 FIG. 3) existed of the top of the bridge (10 FIG. 2) relative to the string plate (12 FIG. 2) have now changed. Conversely, any change which we make in the top surface of the bridge (string angles) will cause a new amount of compression of the soundboard (11 FIG. 2). when the piano is strung and at pitch.

The above objects and considerations are accomplised by the below described manufacturing processes.

Figure 1:
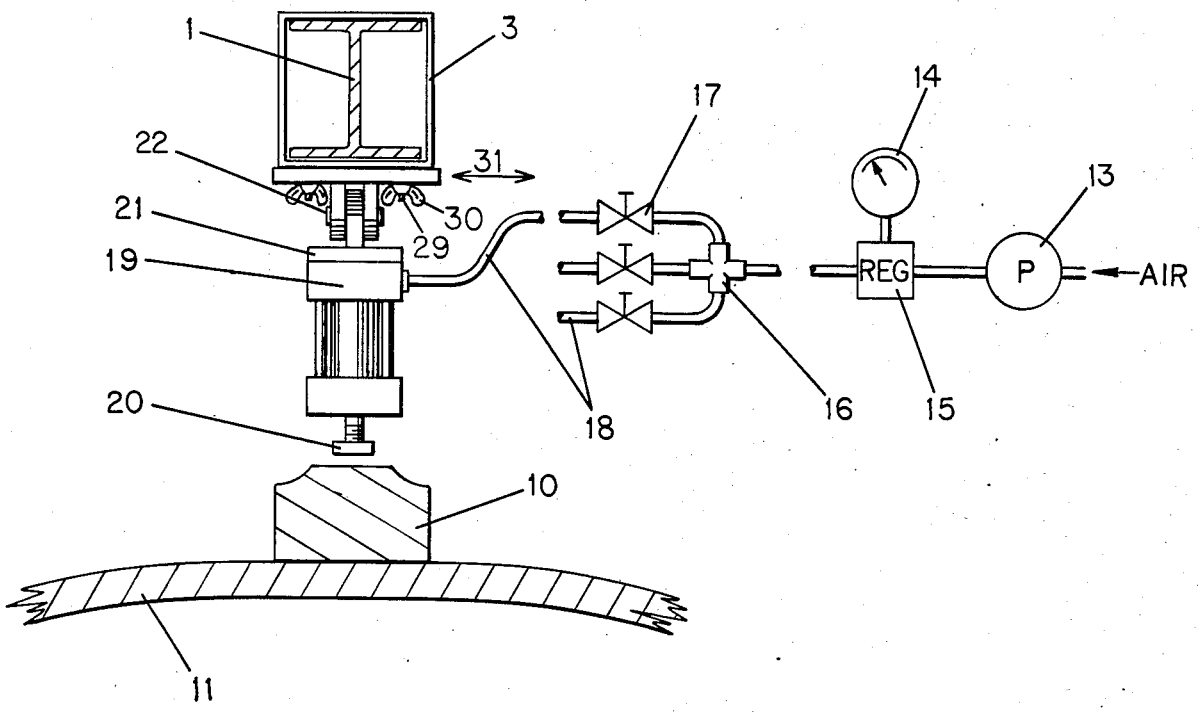
FIG. 1 is a partial sectional view of a griand piano soundboard, bridge, and plate assembly, along with a side view of the soundboard compression air cylindars at rest.
Figure 4:
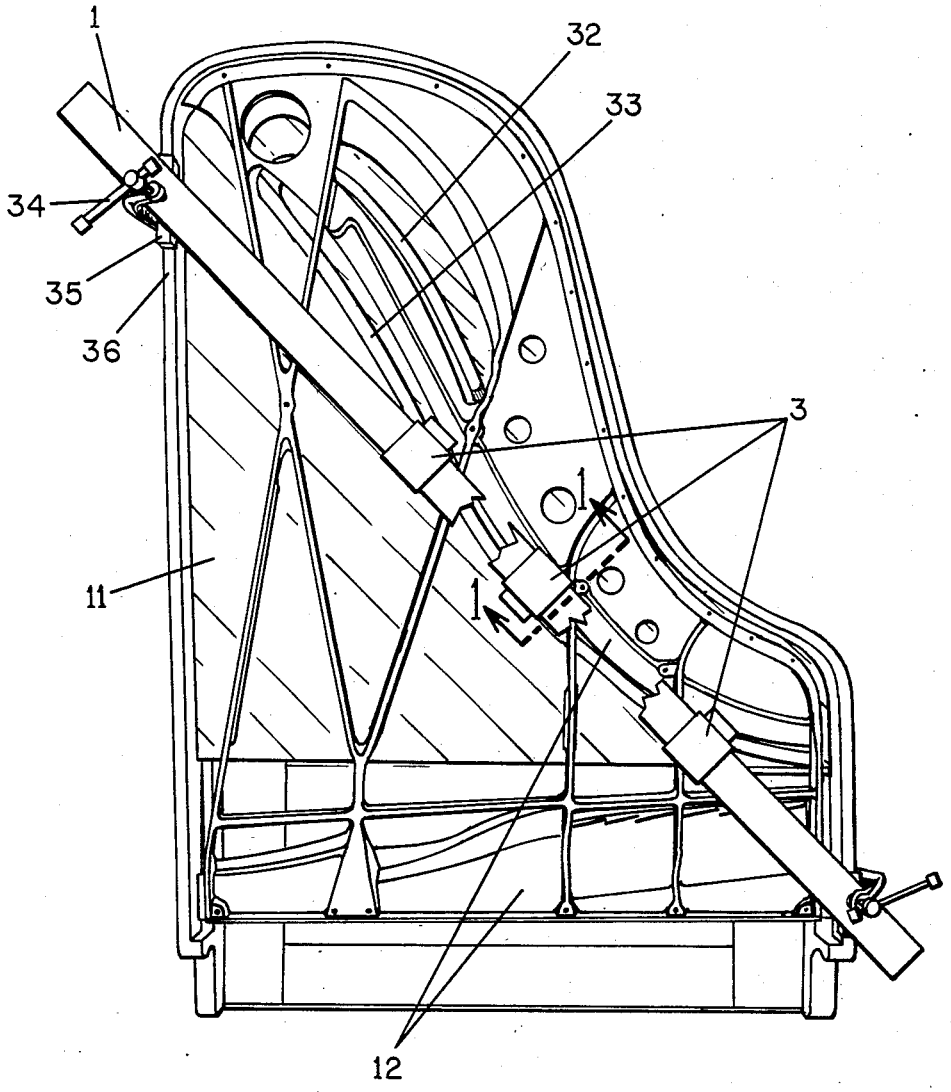
FIG. 4 is a plan view of a piano with said invention in place.

The process begins at the stage where the piano soundboard with extra height bridges, and finished ribbing is glued to its inner rim assembly and the plate is located. The soundboard compression air cylindar assemblies (1 and 3 FIG. 4) are then affixed with spacers (35 FIG. 4) and clamps (34 FIG. 4) so that two cylindars are over the bass bridge (32 FIG. 4) and three cylindars are over the treble bridge (33 FIG. 4). The upper mounts (21 FIG. 1) of the cylindars are affixed to an adjustable mount (3 FIG. 1) which resists upward movement of the cylindar relative to the string plate (12 FIG. 2). The soundboard compression force desired for this piano has been predetermined. Past experience has shown a total amount of 400 lbs. to 2,000 lbs to be in a satisfactory range. However an exact amount may be empirically derived for a particular model piano. To more fully describe the present invention we will use a figure of 400 lbs total soundboard loading when the piano strings are fully tensioned (at pitch), with 300 lbs on the treble bridge (33 FIG. 4) and 100 lbs on the bass bridge (32 FIG. 4).

The two bass bridge compression cylindar plungers (20 FIG. 2) are lowered atop the surface of the bridge until a reading of 50 lbs appears on the air pressure gauge (14 FIG. 1) for each cylindar. The opening and closing of gate valves (17 FIG. 1) allows for each cylindar to be controlled individually. The total amount of force being exerted upon the bass bridge at this point would be 100 lbs. Next the three treble bridge compression cylindar plungers are lowered atop the surface of the treble bridge until a reading of 100 lbs appears for each cylindar. The total amount of force being exerted upon the treble bridge would be 300 lbs. At this point the soundboard is fully loaded to specifications of 400 lbs total load. The next step is to adjust by planing, the top surface of the bridge (10 FIG. 3) relative to the string plate (12 FIG. 3) so that string angles (2, 4 FIG. 3) are formed whereby the current compression of the soundboard (11 FIG. 3) will be maintained when the cylindars are released and the piano is strung and up to pitch. To determine what these angles must be we need to know how many strings occur on each bridge. Let us assume we have 50 strings on the bass bridge and 150 strings on the treble bridge. Therefore, each string must exert 2 lbs force downward upon the soundboard to maintain its current state of compression (50 strings×2 lbs/string+150 strings×2 lbs/string=400 lbs). The scale of the piano (a function of wire size, string length, and pitch) determines the horizontal tension of the strings at pitch. If the scale was such that each note had a tension of 100 lbs, then by calculation we can determine the angle at which the bridge (10 FIG. 3) must deflect the string to cause a force of 2 lbs to be exerted towards the soundboard. 2 lbs=(100 lbs)(tang angle x) tang angle x=0.020

With this specification in mind, the worker proceeds to make sample notches in the top surface of the bridge until said specification angle is achieved across the bridge relative to the string plate, while the soundboard is in its compressed condition. Various measuring devices, and jigs can be used by the worker to help determine how and where the bridge needs to be notched to achieve said angles. One such tool is a Bubble type Piano String Angle Gauge (Patent Pending-Inventor: Thomas A. Lowell). The procedure for using this tool is as follows: the worker first puts a series of sample piano strings across the bridge and pulls them roughly to pitch. Next the worker uses the gauge to measure the net angle made by the deflection by the bridge of the piano string. The worker can then proceed to make further modifications of the bridge surface while being able to gauge the results of the previous work. By using the Bubble Type Piano String Angle Gauge, the worker can adjust the bridge-string plate relationship so that the net string angle can be divided roughly equally (or however it is deemed desireable) between the Front string angle (2 FIG. 3) and the Rear string angle (4 FIG. 3) so as to achieve the desired string configuration as described above. Once sufficent notches are made to be an accurate guide for one skilled in the art to surface the remainder of the bridge, the air cylindars are lifted so that the remainder of the bridge can be planed to correspond with said previously created notches.

Once the bridge is planed, pinned, strung, and the piano up to pitch, the soundboard will then recompress to its former state of compression which existed while it was loaded by the air cylindars, and its Front and Rear string angles will be relatively equal, and in the desired downward configuration.

Modifications may be made in the invention without departing from the spirit of it. For example, the sleeve (3 FIG. 1) to which the air cylindar mounts are attached may be slotted and chamfered so as to allow flathead bolts (29 FIG. 1) and thus the air cylindars to slide laterally (31 FIG. 1) when the wing nuts (29 FIG. 1) are loosened. For example, other similar soundboard loading and bridge adjustment procedures are possible: In one such alternative system the apparatus which is used to compress the soundboard is a spring loaded force gauge which is affixed above the bridge so that it can be lowered down upon the bridge so as to compress the soundboard, whilst the force which it is exerting read out upon said gauge. In another method of gauging the bridge-string plate relationship, thin templates are used which span the entire string length and which are cut out at the point where it spans the bridge so that when the template is placed across the bridge as the corresponding string at that location would travel, the top surface of the bridge when properly adjusted would be flush to the cut out portion of the template.

I claim:

1. In a piano having a string plate with string plate bridges, string tensioning means, soundboard string bridges and a soundboard, the elevations of said string plate bridges relative to said soundboard string bridges being such that said soundboard deflects slightly upon the tensioning of said strings, a method for ease and precision of constructing said relative elevations of string plate bridges and soundboard string bridges, said method comprising the steps of:

a. applying a substantially predetermined amount of pressure to said sounboard string bridges to deflect said soundboard while simultaneously b. adjusting the elevations of said string plate bridges and or said soundboard string bridges relative to each other whereby the amount and direction of force exerted by said strings when fully tensioned upon said soundboard string bridges and soundboard will substantially be of a predetermined amount.

2. A machine for applying substantially exact amounts of pressure upon soundboard string bridges and soundboards, said machine comprising: air cylindars connected to an on-off switchable regulated air supply, output of said regulated air supply being connected to a pressure indicator callibrated to said air cylindars, and supporting means for attaching the components to and substantially rigidly affixing said air cylindars above said soundboard string bridges whereby the pressure output of said air cylindars upon said soundboard string bridges can be effectively controlled, so that the pressure of string downbearing can be simulated upon the soundboard string bridge and soundboard.

3. The method in claim 1 wherein the supporting means for affixing said components to and rigidly position said pressure producing means comprises beams supported by blocking means upon the piano's case, said beams being affixed to said blocking means and case by clamping means.

4. The method claimed in claim 1 wherein the supporting means for said pressure producing means are integrated into the structure of the ceiling of the room the piano is located in.

5. The method claimed in claim 1 wherein pianos having a string plate fitted with string plate bridge type hitch pins wherein the positions of engagement of the strings upon said string plate bridge hitch pins can be raised or lowered so as to adjust the effective elevation of said string plate bridges relative to the soundboard string bridges, a second method for adjusting said relative elevations comprising the steps of:

a. applying a substantially exact predetermined amount of pressure to said soundboard string bridges to deflect said soundboard, said pressure being in an amount substantially equalling the amount desired to be exerted by the fully tensioned strings.

b. raising or lowering said positions of engagment of said strings upon their respective string plate bridge type hitch pins whereby the effective elevations of siad string plate type hitch pins relative to the soundboard string bridges are such that said strings when fully tensioned will exert a substantially predetermined amount of pressure upon said soundboard string bridges and soundboard, said amount of pressure being substantially equall to the amount of pressure applied in a. above.

6. The method claimed in claim 5 wherein the means for applying a substantially exact predetermined amount of pressure to said soundboard bridges to deflect said soundboard is a machine comprising: air cylinders connected to an on-off switchable regulated air supply, output of said regulated air supply being connected to a pressure indicator callibrated to said air cylindars, and supporting means for attaching the components to and substantially rigidly affixing said air cylinders above said soundboard string bridges whereby the pressure output of said air cylindars upon said soundboard string bridges can be effectively controlled, so that the pressure of string downbearing can be simulated upon the soundboard string bridges and soundboard.

7. The method claimed in claim 1 wherein the method for adjusting the elevation of the soundboard string bridge comprises the following steps:

a. permanently affixing a string bridge, which is oversized in elevation, to said soundboard, and temporarily installing said soundboard in the piano rim,
b. temporarily installing said string plate in the piano,
c. applying said predetermined pressure to deflect said soundboard,
d. using cutting means to notch said oversized bridge at sample locations to a depth so that a straight edge means when positioned to rest upon the front string plate bridge means, and the rear string plate bridge means occupies substantially the same plane as the bottom of the notch in said soundboard string bridges,
e. removing said string plate from the piano,
f. removing said soundboard from the piano, and using a cutting means to trim said oversized bridge elevation to the depth of said sample notches.

8. The method claimed in claim 7 wherein the structure of the straight edge means is as follows: a rigid straight edge means of a length, width, and depth enabling it to occupy substantially the desired path of the piano string between the front string plate bridge, across the soundboard string bridge, to the rear string plate bridge, the portion of said straight edge means to be positioned over said soundboard string bridge being notched out as needed so that the lowest surface of said notch will rest flush upon a sample soundboard string bridge notch when said soundboard string bridge notch has been adjusted to the desired elevation, whereby the inclination of said straight edge means notch relative to said straight edge means can be constructed as needed so that the front string bearing angles and rear string bearing angles are substantially equal, or of another predetermined configuration.

9. The method claimed in claim 1 wherein the amount of substantially exact predetermined amount of pressure applied to said soundboard string bridges equals the sum of the amount of pressure desired to be exerted by the fully tensioned strings plus the amount of additional pressure required to reduce the string deflection which would occur in conjunction with the said final amount of pressure desired to be exerted by the fully tensioned strings to zero.

10. The method claimed in claim 1 wherein the initial pressure applied to said soundboard string bridges and soundboard is of the amount and distribution desired to be exerted by the strings when fully tensioned and the relative elevations of the soundboard string bridges and the string plate bridges are adjusted so that said predetermined initial pressure above will be exerted upon said soundboard string bridges and soundboard by the strings when they are fully tensioned, whereby the initial soundboard deflection resulting from said initial predetermined pressure will be replicated by the pressure of the strings when they are fully tensioned.

11. In a piano having a string plate, with string plate bridges, string tensioning means, soundboard string bridges and a soundboard, a method for determining the flexibility of said soundboard comprising the steps of:

a. deflecting said soundboard under a wide range of pressures, the pressure being provided by a pressure producing means mounted rigidly above said soundboard,
b. measuring and recording the deflection of said soundboard at each level of pressure, whereby the approximate spring constant of said soundboard can be determined, said spring constant being a quantitative means of identifying said soundboard's flexibility.

12. The method claimed in claim 11 wherein the pressure producing means is a machine comprising: air cylindars connected to an on-off switchable regulated air supply, output of said regulated air supply being connected to a pressure indicator callibrated to said air cylindars, and supporting means for attaching the components to and substantially rigidly affixing said air cylindars above said soundboard string bridges whereby the pressure output of said air cylindars upon said soundboard string bridges can be effectively controlled, so that the pressure of string downbearing can be simulated upon the soundboard string bridge and soundboard.

13. The method claimed in claim 12 wherein supporting means for affixing said components to and rigidly positioning said pressure producing means comprises beams supported by blocking means upon the piano's case, said beams being affixed to said bocking means and case by clamping means.

14. The method claimed in claim 12 wherein supporting members for said force producing means are integrated into the ceiling of the room said piano is located.

15. The method claimed in claim 11 wherein callibratible measuring means attached to string plate struts are positioned so that the probe of said callibratible measuring means rests upon the soundboard string bridge or soundboard, whereby readings of soundboard deflections can be taken at several locations along the bridge without the necessity of additional support members for positioning said measuring means.

16. The method claimed in claim 15 wherein said mesuring means comprises a callibratible dial indicator gauge.

17. A method of acheiving a predetermined soundboard flexibility in musical instruments comprising the steps of:

a. applying known quantities of pressures to said soundboard,
b. measuring the deflections of said soundboard under said known quantities of pressures,
c. reducing or increasing or otherwise changing said soundboard thickness or soundboard rib construction so that a predetermined amount of pressure applied to said soundboard will result in a corresponding anticipated amount of soundboard deflection, whereby a predeterminged soundboard flexibility, quantitatively expressed as a function of said soundboard's spring constant, can be achieved.

* * * * *